US006446321B1

(12) United States Patent
Marchal et al.

(10) Patent No.: US 6,446,321 B1
(45) Date of Patent: Sep. 10, 2002

(54) METHOD FOR PRODUCING PIPES TO BE CONNECTED IN A DOUBLE-WALL PIPING SYSTEM AND IMPLEMENTING MACHINE

(75) Inventors: Philippe Marchal; Mathieu Rivier, both of Louveciennes (FR)

(73) Assignee: ITP (FR)

( * ) Notice: Subject to any disclaimer, the term of this patent is extended or adjusted under 35 U.S.C. 154(b) by 0 days.

(21) Appl. No.: 09/601,137

(22) PCT Filed: Dec. 8, 1999

(86) PCT No.: PCT/FR99/03064

§ 371 (c)(1),
(2), (4) Date: Sep. 15, 2000

(87) PCT Pub. No.: WO00/33990

PCT Pub. Date: Jun. 15, 2000

(30) Foreign Application Priority Data

Dec. 8, 1998 (FR) ..... 98 15491

(51) Int. Cl.[7] ..... B21D 39/00

(52) U.S. Cl. ..... 29/455.1; 405/170; 29/237; 29/508

(58) Field of Search ..... 405/154.1, 170, 405/169; 29/237, 508, 455.1; 72/402

(56) References Cited

U.S. PATENT DOCUMENTS

| | | | | |
|---|---|---|---|---|
| 1,818,435 A | | 8/1931 | Smith et al. | |
| 2,311,662 A | | 2/1943 | Hunziker | |
| 2,999,405 A | | 9/1961 | Ewart | |
| 3,768,298 A | * | 10/1973 | Olive-Jones et al. | |
| 3,977,065 A | * | 8/1976 | Johnson | 72/402 |
| 4,019,334 A | * | 4/1977 | Sinclair et al. | 29/237 |
| 4,034,592 A | * | 7/1977 | Chen et al. | 29/237 |
| 4,107,964 A | * | 8/1978 | Smith | 29/237 |
| 4,244,091 A | * | 1/1981 | Kimble et al. | 29/237 |
| 4,345,453 A | * | 8/1982 | Lillbacker | 72/402 |
| 4,360,290 A | * | 11/1982 | Ward | 405/170 |
| 4,781,055 A | * | 11/1988 | Phipps | |
| 4,832,530 A | * | 5/1989 | Anderson et al. | 29/237 |

FOREIGN PATENT DOCUMENTS

| | | |
|---|---|---|
| DE | 2153054 | 5/1973 |
| EP | 0 593 838 | 4/1994 |
| EP | 0610108 A1 * | 10/1997 |
| FR | 2 758 872 | 7/1998 |

* cited by examiner

*Primary Examiner*—David P. Bryant
*Assistant Examiner*—Steven Blount
(74) *Attorney, Agent, or Firm*—Parkhurst & Wendel, L.L.P.

(57) ABSTRACT

A process and machine to make double-walled pipe to be connected end to end, wherein each pipe includes inner and outer tubes arranged coaxially with a ring-shaped space between them except at a connecting area at the end of the pipe where the outer tube is longitudinally retracted with respect to the inner tube. An end-wall of the outer tube is deformed to close off the ring-shaped space by the gradual application of pressure to its wall by means of a series of bars spaced in a ring around a connecting area and tilted over in a radial direction by a crown that is fixed with respect to the outer tube and onto which the bars are attached in an articulated manner.

20 Claims, 3 Drawing Sheets

METHOD FOR PRODUCING PIPES TO BE CONNECTED IN A DOUBLE-WALL PIPING SYSTEM AND IMPLEMENTING MACHINE

BACKGROUND OF THE INVENTION

Field of Invention

The invention essentially relates to so-called double-walled or double-cased piping, that is to say pipes formed in the central part of two coaxial tubes, which are an inner tube and an outer tube. Generally speaking, the aim of such a double wall is to leave a ring-shaped space between the two tubes.

Within this scope, the invention more particularly aims to facilitate the manufacture of the ends of such pipes when this ring-shaped space between two tubes must be closed at the ends of the pipes, for whatever reason. This is notably the case when the ring-shaped space between the double-wall acts as a thermally insulating casing for a fluid flowing inside the inner tube.

By way of a preferred area of application, the invention is particularly well adapted to the conditions of manufacture and implementation of such pipes when they are intended to form the successive sections of a continuous pipeline.

2. Description of the Related Art

In this context, reference will notably be made to the case of pipes for the transportation of petroleum products, commonly known as pipelines. In fact, this case is a characteristic example of pipes of great length, more often than not laid in the open sea. To fulfill both technical and economic requirements, these pipes are factory-made, being mass produced as single tubes before being assembled end to end to form the pipeline.

Additionally, these are single tubes of great length (typically 12 or 24 meters) and diameter (around several tens of centimeters), thereby requiring the ends of the tubes to be designed so as to allow a welding machine access to the inner tubes of two consecutive tubes to enable them to be welded end to end without being hindered by their corresponding outer tubes.

Whether said outer tubes are connected by means of a coupling ring or not, it is usual to close off the ring shaped space between the tubes beforehand, at each end of the different tubes, by means of an intermediate coneshaped part that is suitably oriented and-whose circular ends are respectively welded to the inner and outer tubes of the same pipe.

SUMMARY OF THE INVENTION

The present invention allows the manufacturing operations to be considerably simplified by avoiding the use of such an intermediate part, and this without losing the functions said part ensures when the pipe is considered as a whole, or compromising the overall performance of the pipe. It also allows manufacturing costs to be reduced and the production rate to, be increased.

To this end, it essentially consists in providing an equivalent coupling between the outer and inner tubes by deforming the outer tube at its end part. Said deformation may be advantageously accomplished, in accordance with the invention, such that an accurate and constant welding play is achieved for the subsequent sealed closing of the ring-shaped space remaining in the central part of the pipe and acting as a thermally insulating casing.

The invention may be embodied in different ways, expressed notably in terms of a manufacturing process for double-walled pipes by deformation of an end part around an end part of an inner tube until they are brought together closing off the ring-shaped space that they form together in the central part of the pipe, or expressed in terms of a device in consideration of a machine incorporating means allowing said process to be implemented. It also relates to means to mass produce double-walled pipes that integrates such a machine.

The subject of the invention is thus a process for manufacturing pipes to be connected in a double-walled pipeline, wherein after having brought the inner tube and the outer tube into relatively coaxial positions arranging a ring-shaped space between them up to a connecting area at the end of the pipe where the outer tube is longitudinally retracted with respect to the inner tube, the wall of an end part of the outer tube is deformed by reducing its diameter until its end joins the inner tube closing off said ring-shaped space, acting concentrically by the gradual application of pressure to its wall by means of a series of bars spaced in a ring around said connecting area and that are tilted over in a radial direction by a crown that is fixed with respect to the outer tube and onto which they are attached in an articulated manner.

Said bars are advantageously tilted over by admitting a gradual fluid build-up in a ring-shaped chamber having flexible walls and of variable volume surrounding the assembly of said bars.

A further subject of the invention is a machine intended to implement the process above, wherein it firstly incorporates a mobile rigid structure to be engaged around a connecting area at the end of the pipe where the end of an outer tube is retracted with respect to an inner tube, said tubes arranging a ring-shaped space between each other, and secondly incorporates active organs incorporating a series of bars spaced in a ring and mounted articulated at a rear end onto a fixed crown of said structure that is common to all of them, as well as means to simultaneously tilt over said different bars in a radial direction so as to incline them and bring their opposing front ends towards the longitudinal axis of their annular arrangement.

Advantageously, said means to tilt over said bars incorporate an inflatable ring-shaped chamber, having flexible walls and of variable volume, surrounding the assembly of said bars, and means to allow a gradual fluid build-up in said chamber.

The rigid structure can incorporate containment means for said chamber when inflated, notably incorporating an external casing, and preferably also an inner side to said casing opposite said crown onto which said bars are articulated.

Advantageously, said rigid structure is fitted with lifting and transportation means to engage it around the connecting area by the free end of the pipe, or to disengage it at the end of the operation, when said bars have been brought into their inactive position away from the outer tube wall.

Still advantageously, said structure incorporates means to guide it when moving along the pipe that cooperate with the outer tube in the central part of the pipe so as to ensure that it is centered longitudinally and radially with respect to the pipe axis, said means preferably incorporating, to the rear of an overhanging beam extending longitudinally away from the pipe, symmetrical rollers intended to keep said beam oriented along an upper generating line of said pipe.

Still advantageously, each of said bars puts pressure of the end part of the outer tube via a foot with which it is fitted and which advantageously has a portion having a longitudinal profile that is inclined with respect to said bar.

Still advantageously, at least concerning the said inclined portion, said foot has a concave transversal profile whose curve radius is preferably of the same magnitude as that of the inner tube.

Still advantageously, said rigid structure incorporates radial guiding rods for the different bars, said rods being attached to a central ring, and provided with a return spring for its corresponding bar to bring said bar back to its inactive position away from the outer tube wall.

Each of said bars is held onto said crown by means of catches abutting on the radial faces of said crown.

Each of said bars is advantageously provided with a thin plate oriented perpendicularly to it and sliding on a finger integral with the rigid structure during the operations designed to tilt over the bars.

Still advantageously, a temporary ring-shaped shim is provided that makes welding play between the end of the outer tube and the wall of the inner tube at the end of the machine's operations.

Still advantageously, an intermediate layer of a constant though relatively small thickness is provided around said bars, notably to protect the wall of an inflatable ring-shaped chamber.

The invention also relates to means to mass produce pipes to be connected end to end to make a double-walled pipeline, characterized in that it incorporates a machine such as previously described -for the continuous processing of the ends of consecutive pipes.

DETAILED DESCRIPTION OF THE PREFERRED EMBODIMENTS

The invention will now be more fully described within the scope of the preferred characteristics and their advantages, reference being made to the appended drawings illustrating them in which:

FIG. 1 schematically represents a machine according to the invention being put into place on the end of pipes, in accordance with a partial section view according to a diametral plane of the assembly, FIG. 2 is a perspective view of a detail shown in FIG. 1 featuring the centering rollers according to a rectilinear generating line from the cylindrical surface of the outer tube of the pipe;

FIG. 3 schematically shows the same machine such as it appears seen from the end to the left of FIG. 1;

DETAILED DESCRIPTION OF PREFERRED EMBODIMENTS

Generally speaking, the embodiment described here is the preferred application of the invention and relates to the manufacture of pipes for underwater pipelines for the transportation of petroleum products of the so-called double-casing type.

Each pipe 1 is thus essentially formed, as has already been explained, of an outer tube 20 and an inner tube 10. Conventionally, various stresses are brought on the inner tube such as those generated during the manufacturing operations required to ensure that the ring-shaped space 31 between the two tubes is closed and to weld consecutive tubes end to end thereby forming a continuous pipeline.

Within the same context, given by way of one of the most common examples, the tubes here are considered to be made of steel, it is also considered that the rigid links between the different parts are made by welding, that the ring-shaped space 31 is advantageously occupied by an insulating material implemented in the form of sheets rolled around the inner tube, that the heat insulating capacity can be improved by reducing the pressure in this ring-shaped space, that once two inner tubes have been welded end to end the continuity of a pipeline between consecutive pipes joined at their outer tubes and at their insulating ring-shaped space can, at best, be ensured by using an intermediate part forming a cylindrical linking sleeve between the outer tubes of two consecutive pipes. all these particularities, that are representative of preferential conditions for the invention, are known in themselves and are amply described in prior patent documents of the applicant. It is therefore unnecessary to refer to them in greater detail hereafter.

If the different manufacturing steps are firstly considered in terms of a process, they need to be carried out in a workshop supplied with inner tubes and outer tubes from a steel works, in which each pipe is prepared by sliding an inner tube into an outer tube.

Figure 1:
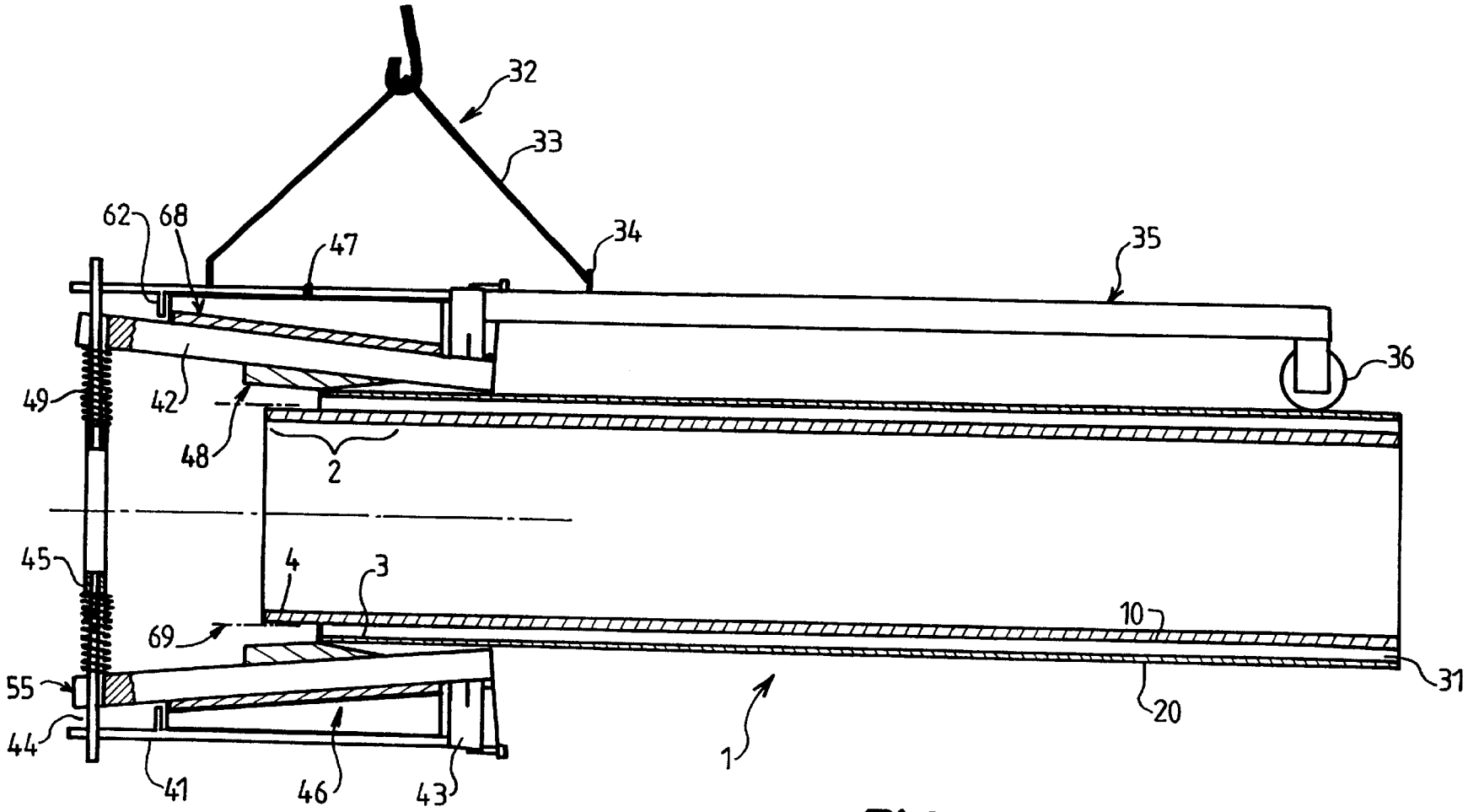

As can be seen in FIG. 1, the inner tube 10 is longer that the outer tube 20, such that at each end of the central part, thus to the left of the Figure, the inner tube juts out from the outer tube. The respective end parts of the two tubes define a connecting area 2 with the opposite end of an identical pipe. The end of area 3 of outer tube 20 is longitudinally retracted with respect to the free end of area 4 of inner tube 10.

The machine used to finish off the connecting area 2 is schematically shown in its entirety in this same FIG. 1.

This machine is able to move so as to continuously process the ends of different pipes.

To this end, it firstly comprises a lifting system 32 enabling it to be suspended from a transport lifting beam. This system is illustrated by a cable 33 hooked onto one of the ring brackets 34 welded to the rigid structure of the machine.

Secondly, the structure supporting the organs used to deform the outer tube is extended by a beam 35 that, in its operational position, is placed along the upper generating line of the central part of the pipe. At its end, to the right of the Figure, it rests on the outer tube 20, on which it is guided during the longitudinal displacement of the machine by rollers 36.

Figure 2:
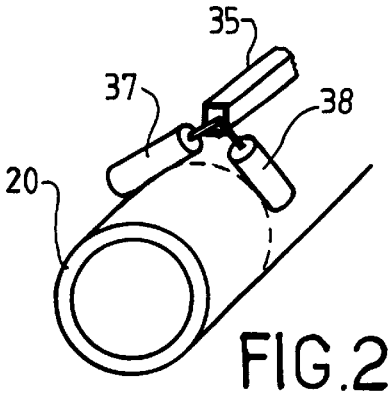

As shown in FIG. 2, these rollers are in fact double, so as to ensure not only the rolling capacity at a constant distance from the pipe, but also the centering of the machine with respect to the upper generating line. These are therefore two centering rollers 37 and 38, oriented symmetrically in a V shape over the tube.

On the opposite side, to the left of FIG. 1, the active organs, so-called because they are used to create the connecting area 2, are of rotational symmetrical geometry.

The rigid structure in which they are mounted incorporates a cylindrical tunnel ring 41 inside which there is a series of tiltable bars 42. These bars are illustrated on the principle that they are all alike. They extend longitudinally forming a ring-shaped crown around the pipe.

To the rear of the machine, the bars 42 are mounted pivoting on a ring-shaped crown 43 integral with the beam 35 and thus also with the tunnel ring 41. When they are tilted over radially, the displacements of their front mobile ends are guided by respective rods 44, these being mounted rigidly between the tunnel ring 41 and a central ring 45.

An inflatable ring-shaped chamber 46 can also be seen in FIG. 1. When this is inflated, by admitting water or another fluid through a connector 47, it fills all the space between the tunnel ring 41 and the bar assembly 42.

Essentially, on the inner side, the bars 42 are finished off by pressure feet 48, and on their mobile ends the bars 42 are individually subjected, in opposition to the pressure coming from the chamber 46, to the action of a helicoidal return spring 49 arranged around the corresponding rod 44 and press firstly on the inner face of the bar and secondly on the central ring 45.

The general principles governing the operation of the machine made in accordance with the invention can already be deduced from FIG. 1 and the preceding description.

It is understood that with the beam 35 overhanging. the tunnel ring 41 forming the casing for the active organs and the lifting. and transport system 32, the machine is automatically brought into a stable and accurate position when engaged longitudinally onto pipe 1, from its free end, and until the feet 48 come to be placed around. the end parts of two tubes intended to form what has been termed the connecting area between two analogous pipes. During this stage, the different bars 42 are tilted into a so-called inactive position under the sole effect of the return springs 49, and in this position (shown in FIG. 6 in particular), their respective feet 48 are placed in the immediate vicinity of the end part of the outer tube 20, without pressing on it, however.

The machine is thus set up to operate. Its active organs are correctly centered on the pipe axis and parallelism is ensured even if the pipe is not held perfectly horizontally on the support cradles (not shown). Additionally, and already at this stage, but also throughout the operation, no substantial pressure can be exerted that is not radial and equally spread all around the pipe axis.

When fluid build-up is finally admitted into chamber 46, generally by introducing pressurized water via connector 47, this chamber inflates and, because the expansion of its variable volume is limited by the tunnel ring 41 which encompasses it, the pressure builds up gradually. It builds up sufficiently to exert a thrust force, in opposition to the action of the springs 49 and the resistance of outer tube 20, onto the bars 42 that are tilted over simultaneously in a radial direction. The feet 48 provide concentric pressure on the outer tube 20 wall, causing it to deform and come closer to that of the inner tube.

The pressure exerted by means of the chamber 46 is at all times evenly spread-over the different bars 42, not only radially around the pipe, but also longitudinally along the outer face of the bars. At the same time, the inclined profile of the portions 63 of the feet 48 results in the outer tube being narrowed gradually from the rear, where there is no narrowing at its junction with the central part of the pipe, to its free front end, where it narrows such that at the end of the operation, the wall of the outer tube touches that of the inner tube fitted with its welding shim, said shim being insensitive to strain. More exactly, the wall of the tube abuts around its whole perimeter on an intermediate shim that will be described hereafter.

The number of bars 42, with their individually associated organs, varies according to the application conditions. It notably directly-relates to the distance that their mobile end must cover when tilted over, thus to the original difference in radius of the two tubes. Moreover, it is calculated such that the space between adjacent bars, where their feet put pressure onto the outer tube, is small enough so as not to cause pinching of the outer tube.

The make-up of each bar 42, with the different fixed or mobile organs associated with it, will now be described in greater detail with reference mainly to FIG. 4, but also, incidentally to the other Figures.

Figures 3, 4:
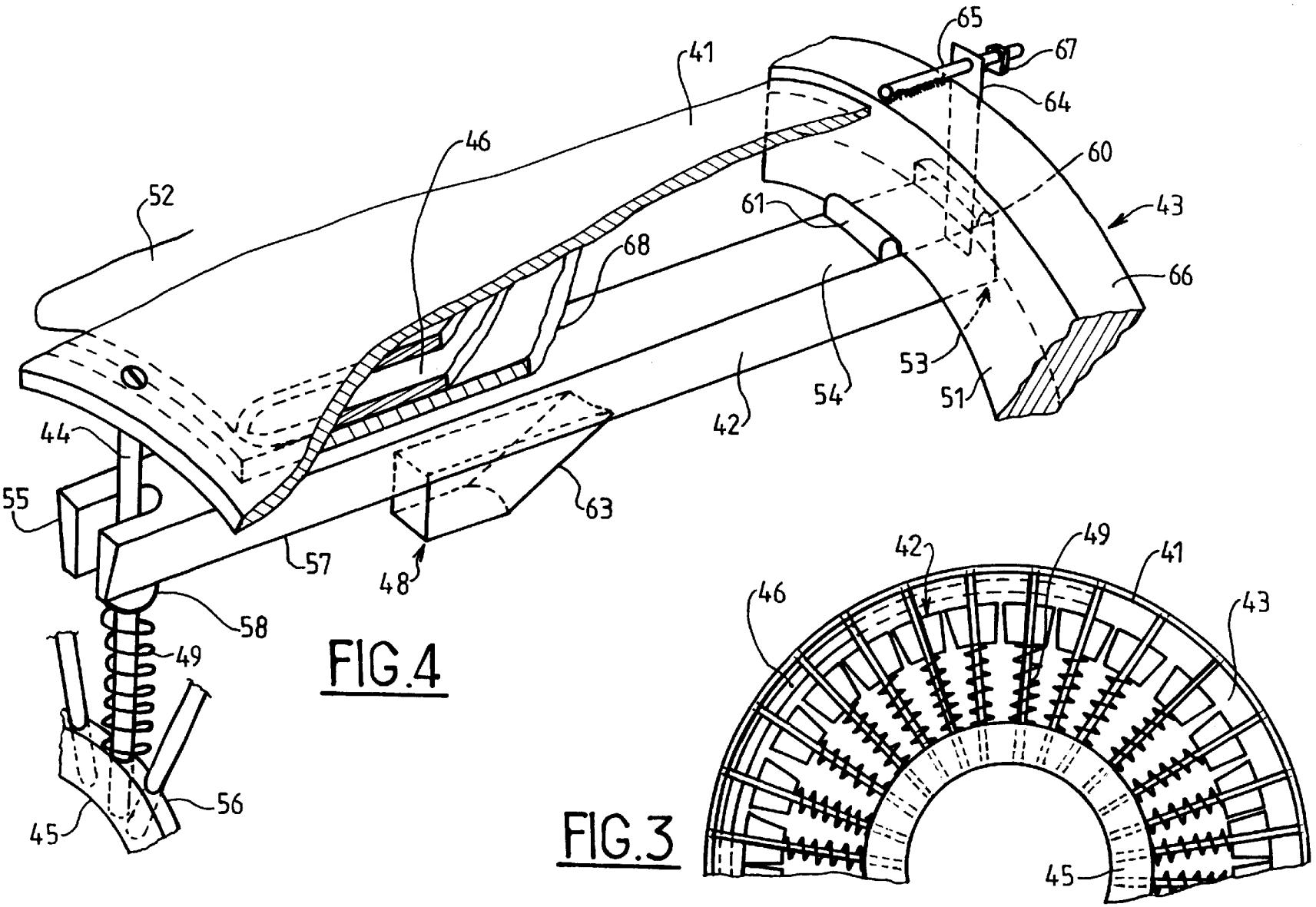
FIG. 4 is a partial perspective view illustrating one of the bars of the machine forming a lever, as it is related to the constitutive elements of the rigid structure.

FIG. 4 shows the crown 43, which is in fact fixed, welded onto the beam 35, as well as the other fixed elements that are the tunnel ring 41, welded onto the front face 51 of the crown 43, and the rod 44 belonging to the bar 42 shown.

As has already been explained, this rod 44 forms an integral part of the rigid structure. It is engaged through the tunnel ring 41 until its head comes into abutment away from the longitudinal axis of the machine. At its opposite end, it is threaded and fastened by screwing into the outer section of the central ring 45. The rigidity of said ring assembly is simply a result of the combined effect of the different rods 44.

With regard to the-active organs, from FIG. 4 it can be-understood that the chamber 46, the flexible wall 52 of which is partially shown, extends continuously around the bar 42 assembly. It can be more clearly seen in FIG. 3 that the different bars 42 are practically contiguous, at least by their rear articulated ends 53 and their outer faces 54.

At its front end, each bar 42 forms a fork 55 thanks to which it is intersected by its corresponding rod 44. As can be clearly seen in FIG. 4, the spring 49, intended to make the bar 42 tilt into its inactive position by inclining it on the longitudinal axis away from the pipe, firstly presses on the outer section 56 of ring 45, and secondly on the radially inner face 57 of the bar 42, via a washer 58.

The presence of a fork 55 rather than a simple opening is essentially in response to concerns over manufacturability by mounting the different bars onto the rigid structure inside the tunnel ring 41. Similarly, it can also be observed in FIG. 4 that the bar 42 is linked to the crown 43 by means ensuring a fixed position of the rear end whilst allowing the articulation necessary to tilt over the bar.

To the rear of the bar 42 a thin plate 64 has been provided, welded onto it and oriented perpendicularly to the bar towards the outside. Its main role is to facilitate the assembly of the bars on the crown 43. To this end, the thin plate 64 is associated with a finger 65 welded longitudinally onto the outer face 66 of the crown 43 (or otherwise made integral with the rigid structure) and which passes through the end of the plate 64 itself.

During the assembly operations, each plate thus prevents the bar to which it belongs from disengaging from-the crown 43. Thereafter, the plate 64 slides-freely on the finger 65 during the tilting operating of-the bar 42 between two extreme positions that correspond on the one hand to the abutment of the plate 64,on the rear face of the crown 43, and on the other to its abutment on a nut 67 placed at the tip of the finger 65.

Furthermore, the bar 42 is fitted with two catches 60 and 61 that frame the crown 43, in abutment on its rear and front faces respectively (reference 51 for the front face in FIG. 4). The main aim of these catches is to prevent the bar from sliding longitudinally with respect to the crown 43. They thus contribute, in addition to the plate 64 associated with the same bar, to keeping this bar tilting around a fixed hinge point.

Figure 6:
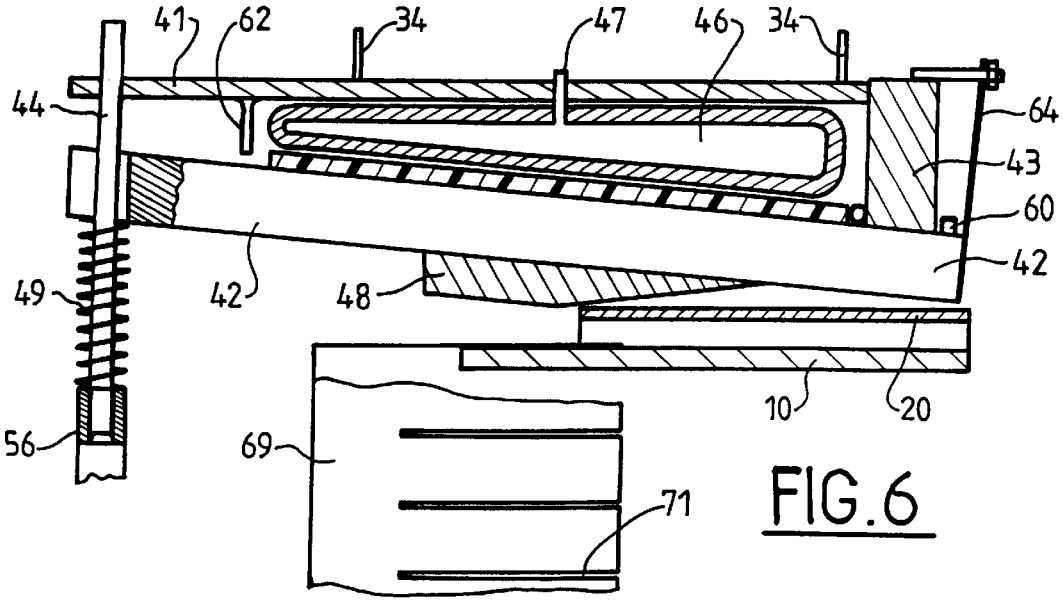
FIG. 6 shows the active organs of the machine in a partial view of a longitudinal section, their position being, as for FIG. 1, that which they occupy before commencing their action on the tube to be deformed.
Figure 7:
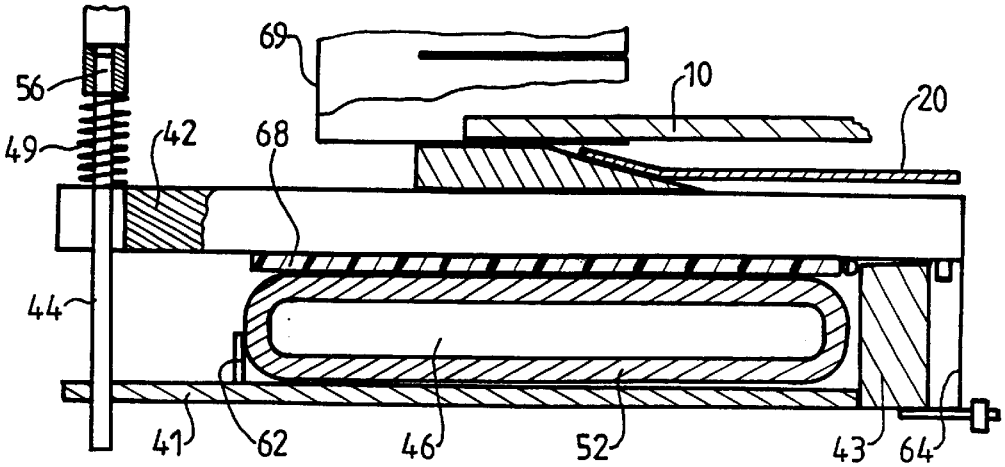
FIG. 7, also a detailed view, showing a partial longitudinal section similar to that in FIG. 6, but where the bars are in their final position on the end of the finished pipe.

As a variant of the embodiment shown by way of a particularly advantageous example, the bars 42 can be more simply mounted in the crown 43 by means of screws passing through their thickness and leaving some play. This play enables the same freedom of inclination to be achieved along the longitudinal axis. In this case, as in that using the plates 64, it may always be useful, with respect to the rectilinear inner face of the bars 42, for the inner section of the crown 45 to have a slightly rounded profile such as is shown in FIGS. 6 and 7.

Figure 5:
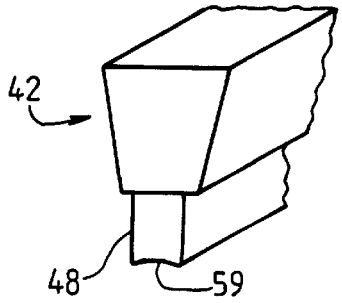
FIG. 5 shows the shape of a bar and notably its foot, giving a detailed view of its transversal profile.

Lastly, reference must be made not only to FIG. 4, but also to the details shown in FIG. 5, to observe that, at least concerning its portion 63 having a longitudinal profile inclined with respect to the bar 42 (FIG. 4) that presses on the outer tube of the pipe, each foot 48 has a concave curved transversal profile 59.

The same Figures also show the transversal profile of the bars 42 in connection to the feet they carry. For each actual bar, this is trapezoidal, having lateral faces that are inclined to match the radii of the machine towards the pipe axis, the inner face accommodating the foot 48, said foot being essentially rectangular in section and of a lesser width.

The dimensions are calculated to as to limit the gap between adjacent bars as much as possible when they move from the inactive position to their final active position in parallel to the deformation of the end part of the outer tube. These dimensional conditions are essentially applied to the bars considered at their feet, and principally according to the inner face of these feet.

More specifically with respect to this inner face of the feet 48, the curve radius of the active surface 59 (FIG. 5) pressing against the outer tube is advantageously of the same magnitude as that of the inner tube at its end part 2, and is thus locally smaller than that of the outer tube. This arrangement, combined with the above-mentioned dimensional conditions, contributes to maintaining an even surface following the tube perimeter, in that the appearance of flat parts alternating with more curved parts is avoided.

In the same aim, but also in the aim of satisfying the goal of minimal bulk for maximal effectiveness, energy efficiency with respect to the inflatable chamber and limiting of the longitudinal stress, the assembly is constructed such that in their inactive position, the bars 42 are inclined along the axis of the pipe 1, absent from any contact between the feet and the not yet deformed outer tube 20, and in that in their final active position, they are simply brought into parallel with the axis of the pipe.

Matching positions also prevent the wall 52 of the inflatable chamber 46 from being damaged by getting caught between the metallic parts of the assembly. This is why an intermediate layer 68 (FIG. 1) has been placed around the bar 42 assembly. Said layer is of a constant thickness. It essentially acts as protection for the wall of the inflatable chamber 46. Like the latter, it is made, for example, of rubber.

For the remainder, the volume that the ring-shaped chamber 46 fills in its inflated state is limited by a ring-shaped side 62, arranged opposite the support crown 43. This side is welded to the tunnel ring 41, perpendicularly to it on its inner face, which acts as a containment casing for the inflated chamber, in combination with the crown 43 and the side 62.

At the end of the operation, when the bars are in the position shown in FIG. 7, the outer tube 20 wall has been deformed by giving a conical shape to its end part 3, this deformation being carried out until the free end of the tube encounters the resistance of the end part if of the inner tube 10. It is at this point that, after having released the pressure in the inflatable chamber as soon as said pressure exceeds a predetermined threshold, and having disengaged the machine from the pipe, the two pipes are wielded together.

With respect to known techniques in which the conical end of the outer tube is formed by an intermediate part, one of the two welding operations is-thus avoided, and in addition the problems caused before by the inevitable irregularities of the tube sections are no longer encountered., For large diameter tubes in particular, the tube contours are known never to be perfectly circular and that the respective ovalization of the two coaxial tubes, of a double-walled pipe can not be made to match exactly.

When it was indicated above that, the outer tube wall is tapered until its end comes into contact with the inner tube, this is not literally the case in practice. In fact it is useful to leave some play for welding between the two tubes. To this end, a temporary ring-shaped shim 69, appearing mainly in FIGS. 6 and 7, is placed around the inner tube 10.

This shim is of a constant thickness, practically insensitive to the pressure of the active organs of the machine according to the invention, so long as it fits closely to the contours of the inner tube. This explains why no account has been taken of this before, as it is considered that it is an integral part of the inner tube 10 during all the deforming operations carried out on the outer tube 20, It can be easily removed when the bars 42 (or more precisely their feet 48) release their pressure, because of the spring-back of the outer tube. The play between the inner and outer tubes is thus constant (with a tolerance equal to the thickness of the shim), thereby facilitating subsequent welding operations intended to close-of the ring-shaped space between the two tubes and improving the quality of the weld obtained.

Moreover, the temporary shim 69 shown in FIG. 6 advantageously presents weaker strips 71, or even pre-cut lines, extending longitudinally, at least around the part of its length fitted between the tubes thus providing welding play. The aim of this is to improve its ability, beyond the fact of its being very thin, to adapt itself to the inevitable irregularities of the perimeter of the inner tube 10, more so than would be the case by the other part of its length.

By way of example, considering the case of a pipeline, of standardized 10 inch diameter for the inner tube and 12 inches for the outer tube, a machine can be manufactured such as that which has just been described with 25 or 26 active bars spread at angular intervals of around 14 degrees and each having a 40 mm wide foot. The play between the feet is of around 7 mm at the beginning of the operation to tilt the bars. At the end, the absence of pinching effects on the narrowed tube can be noted.

As can be seen from the Figures, it is preferable for the bars 48 to be considerably longer than their respective feet 42 pressing on the end part 3 of the outer tube of the pipe to be processed. The pressure applied onto the tube by the portion 63 having an inclined longitudinal profile is thus all the greater with respect to the fluid pressure in the inflatable chamber at a given time during the gradual pressure build-up.

Other manufacturing particularities as have been described contribute to operating efficiency. This is notably the case for the use of catches 60–61, that oppose any action tending to push the bars towards the rear of the machine in the longitudinal direction of the tube during processing, whereas the role of the plates 64 is rather to retain the bars in a radial direction. This is also the case due to the fact that the surface of the bars pressing on the end part 3 of the outer tube by means of the feet 48 is inclined. Lastly, it may be noted that the length of the end part 3 to which a tapered shape is given can be freely chosen with respect to the thickness of the ring-shaped space 31 such that the tapering induced is slight enough so as not to risk generating local mechanical stresses in the wall of the outer tube 20.

It is quite clear from the above description-that the invention has achieved its goals. It may be noted that the machine is easy to move so as to continuous process the ends of successive pipes intended to be connected end to end to form a continuous pipeline, by welding closed the ring-shaped space between the inner and outer tube, including in the event that an insulating material is placed in this space in the meanwhile. The welding operations are made easier by the fact that the welding play previously arranged by means of the shim described, is constant in thickness. In addition, because water is used as a pressurized fluid in the inflatable chamber, the welding operations are not endangered by potential oil leaks and cleaning operations can be carried out by blow torch.

But naturally, and as can be clearly seen from the above, the invention is in no way limited by the specific indications that have been supplied with respect to specific industrial conditions of application. It extends not only to all variant embodiments where specific dimensional data differs from that given, but also to any variant that uses means different from those described but which fulfill the same functions.

To speak of only one of the multiplicity of example cases possible, it is obvious that each foot 48 could be made in a single part with the corresponding bar 42, whereas here it has been described as preferably being a separate part made integral with the bar itself, which would be the case more often than not, if only for technological reasons of metallurgical manufacturability.

It is also obvious that within the scope of the manufacture of pipeline by assembling double-cased pipes end to end, the above-described process to connect the end parts of the outer and inner tubes of the same pipe could just as easily be applied to the connection between a coupling ring between two consecutive pipes of a same pipeline and each outer tube of said pipe. As access is required in order to be able to operate on the central part of the outer tubes, the inner tubes being already welded end to end, the machine in the above example will advantageously be used by placing springs 49 at the external side of the bars onto guiding rods mounted on an external ring.

What is claimed is:

1. A process for manufacturing double-walled pipes to be connected together to form a double-walled pipeline, comprising:

providing a coaxial arrangement of an inner tube and an outer tube space having a cylindro-annular space extending in the axial direction therebetween to form a double-walled pipe;

axially retracting said outer tube with respect to said inner tube to reveal an. inner tube end portion, wherein an adjacent end wall portion of said outer tube defines a connecting area;

gradually applying pressure concentric to said connecting area, thereby deforming the adjacent end wall portion by reducing an outer diameter of the outer tube end wall until an inner surface of said end wall abuts an outer surface of said inner tube end portion, thereby closing only an end of said space so that substantially the remainder of said space remains, said pressure being applied by arranging a plurality of bars spaced circumferentially around said connecting area and tilting said plurality of bars, wherein each of said bars moves along a plane extending substantially radially outward from, and in alignment with, the center axis of a crown, said crown fixed with respect to said outer tube and to which said bars are attached in an articulated manner.

2. The process according to claim 1, wherein said bars are tilted by gradually admitting fluid into a chamber having flexible walls and variable volume surrounding the plurality of bars.

3. The process according to claim 1, further comprising the step of continuously processing ends of consecutive double walled pipes to make a double-walled pipeline.

4. A machine for manufacturing double-walled pipes to be connected to form a double-walled pipeline comprising:

a mobile, rigid structure for concentrically engaging a connecting area at an end of a double-walled pipe having a coaxial arrangement of an inner tube and an outer tube, said double-walled pipe having a cylindro-annular space extending in the axial direction therebetween, the outer tube being axially retracted with respect to the inner tube to reveal an inner tube end portion, wherein an adjacent end wall portion of said outer tube defines said connecting area;

a crown fixed to said structure and for operationally being fixed with respect to said outer tube;

a plurality of bars having opposing front ends, said bars arranged in an annular pattern around said crown and in articulated attachment to said crown, said bars for being operatively tilted toward the center axis of the crown, each bar thereby moving along a plane extending substantially radially outward from, and in alignment with, the center axis of the crown;

means for simultaneously tilting said plurality of bars in a radial direction to incline said opposing front ends toward said axial direction.

5. The machine according to claim 4, further comprising said machine in combination with means for continuously processing ends of consecutive pipes.

6. The machine according to claim 4, wherein said means for simultaneously tilting said plurality of bars further comprises an inflatable ring-shaped chamber having flexible walls and variable volume, said chamber surrounding the plurality of bars, and means attached to said chamber for allowing a gradual fluid build-up in said chamber.

7. The machine according to claim 6, wherein said rigid structure further comprises containment means for containing said chamber.

8. The machine according to claim 7, wherein said containment means comprises an external casing.

9. The machine according to claim 7, wherein said containment means comprises an external casing having an inner side opposite said crown, wherein said plurality of bars are in articulated attachment to said inner side.

10. The machine according to claim 7, wherein said rigid structure is fitted with lifting and transportation means for engaging said connecting area or disengaging said connecting area after said plurality of bars have been brought into an inactive position away from the outer tube wall.

11. The machine according to claim 10, wherein said structure incorporates means for guiding said machine along the pipe, said means for guiding also for co-operating with the outer tube at a central part of the pipe to ensure that the machine is centered longitudinally and radially with respect to the pipe axis.

12. The machine according to claim 11, wherein said means for guiding further comprises an overhanging beam extending longitudinally away from the crown, symmetrical rollers attached to an end of the beam and for keeping said beam oriented substantially parallel with an outer surface of said pipe, said end of the beam being opposite to the crown.

13. The machine according to claim 11, wherein each said bar includes a foot having a surface with a longitudinal profile that is inclined with respect to said bar, wherein the foot of each of said plurality of bars is for operatively applying pressure to the connecting area of said outer tube.

14. The machine according to claim 13, wherein each said inclined profile includes a concave transverse profile having a radius of curvature of the same magnitude as that of said inner tube.

15. The machine according to claim 14, wherein said rigid structure further comprises a plurality of radial guiding rods each corresponding to a respective one of said plurality of bars, said rods being attached to a central ring, wherein each of said rods has a cooperating return spring to urge its corresponding bar back to an inactive position away from said outer tube wall.

16. The machine according to claim 15, further comprises catch means for holding a respective bar onto said crown.

17. The machine according to claim 16, wherein said catch means is a portion protruding from a respective bar and cooperatively abutting a radial face of the crown.

18. The machine according to claim 16, wherein each of said bars further comprises a thin plate oriented perpendicularly to said bar, said thin plate for sliding on a finger integral with said rigid structure when said bars are tilted during use.

19. The machine according to claim 18, further comprises a temporary ring-shaped shim for facilitating welding between the end of said outer tube and the wall of said inner tube.

20. The machine according to claim 19, further comprises an intermediate layer of uniform thickness around said bars, said layer for protecting said wall of said inflatable ring-shaped chamber.

* * * * *